United States Patent [19]

Bubley

[11] Patent Number: 4,512,563

[45] Date of Patent: Apr. 23, 1985

[54] TAKEOFF METHOD AND APPARATUS

[75] Inventor: Henry J. Bubley, Deerfield, Ill.

[73] Assignee: American Screen Printing Equipment Company, Chicago, Ill.

[21] Appl. No.: 436,833

[22] Filed: Oct. 26, 1982

[51] Int. Cl.[3] ..... B65H 29/10

[52] U.S. Cl. ..... 271/85; 101/232; 198/486; 294/104; 414/753

[58] Field of Search ..... 271/85, 84, 268, 267, 271/277, 82, 204, 206, 226, 237; 234/104; 414/751, 753, 225, 226; 198/486; 101/232, 408, 409, 411, 230

[56] References Cited

U.S. PATENT DOCUMENTS

| | | | |
|---|---|---|---|
| 1,869,403 | 8/1932 | Belluche | 271/277 |
| 3,376,036 | 4/1968 | Weir | 271/85 |
| 3,720,408 | 3/1973 | Horn | 271/18 R |
| 3,792,857 | 2/1974 | Bubley et al. | 271/85 |
| 3,860,231 | 1/1975 | Oltra | 271/85 |
| 4,058,223 | 11/1977 | Cruse | 198/486 |
| 4,058,307 | 11/1977 | Bubley et al. | 271/85 |
| 4,242,956 | 1/1981 | Bubley et al. | 101/123 |
| 4,299,532 | 11/1981 | Bouwmeester | 414/753 |

*Primary Examiner*—George E. A. Halvosa
*Assistant Examiner*—John A. Carroll
*Attorney, Agent, or Firm*—Fitch, Even, Tabin & Flannery

[57] ABSTRACT

An apparatus and method are disclosed for individually transporting large sheets of stock which may have curled ends from a planar support surface such as a printing bed to another location, such as a delivery station. The present invention includes lifting members for positioning a leading end of each sheet at a predetermined elevation prior to engagement by a purality of grippers having upper and lower jaws which grip the end of the sheet to transport it. In the preferred embodiment, the lifting member comprises a plurality of pins mounted in the support surface which are driven upward to raise the leading end of the sheet.

12 Claims, 9 Drawing Figures

TAKEOFF METHOD AND APPARATUS

The present invention relates generally to transportation of individual sheets of paper and the like from one location to another, and relates more particularly to a method and apparatus for transporting individual sheets of printing stock from a printing bed to a delivery station in a screen printing operation.

In a typical screen printing operation, a sheet of stock is placed on a planar support surface, or printing bed, by a feed mechanism, and a printing head descends to position a screen over the sheet. A squeegee travels along the upper surface of the screen to push ink through the screen and onto the underlying sheet. The printing head is then raised, and the sheet is removed by a takeoff assembly.

It is well known for a takeoff assembly to employ grippers for gripping an edge of a sheet of stock and pulling the sheet from the printing bed to transport it to a delivery station. See, for example, U.S. Pat. No. 3,792,857 to Bubley et al. A problem which frequently arises in the operation of such grippers, particularly in handling large, heavy sheets, is that curling or bending of the stock causes the leading edge to become misaligned with respect to the grippers so that one or more of the grippers fails to close on the sheet. This may necessitate manual removal of the sheet from the printing bed, which interrupts the printing operation, or may result in damage to the sheet. In order to maintain a high rate of throughput for the printing operation while minimizing loss of stock, it is desirable for a gripper-type takeoff assembly to miss or damage as few sheets as possible.

The printing apparatus described in U.S. Pat. No. 3,792,857 to Bubley et al. has cutout portions formed along the edge of the printing bed adjacent the takeoff to enable the grippers sheet. Although such cutout portions perform the desired function of exposing a portion of the underside of the sheet for gripper access, the cutout portions have been found inadequate for two reasons. First, if the edge of a sheet of stock is curled upward, the grippers may pass below the edge instead of receiving it between them. Secondly, the end of the sheet may be drawn upward from the table when the printing head rises due to the creation of a partial vacuum by the upward movement of the printing head and the exposure of portions of the sheet directly above the cutouts to atmospheric pressure from below. The vertical displacement of the leading edge of the sheet may be great enough to prevent the grippers from properly engaging the sheet, particularly if lightweight stock is involved.

The drop edge mechanism described in U.S. Pat. No. 3,860,231 was developed to permit gripper access without permitting atmospheric pressure beneath portions of the sheet while the printing head moves upward. During printing, the drop edge forms an edge portion of the printing bed and supports the leading end of the sheet of stock. After printing has been completed, the drop edge moves downward while the printing head simultaneously moves upward away from the sheet, so that the pressure is approximately equal on the opposite sides of the leading end of the sheet.

While the drop edge arrangement has proven adequate for handling flat sheets of stock, it has not eliminated mishandling of stock by the grippers where the leading ends of the sheets are curled or bent. Where the leading end of a sheet of stock is curled either upward or downward, portions of the leading edge are either above or below the plane of the printing bed, and may be mishandled by the grippers. Mishandling of stock due to curling of the leading edges of sheets has therefore continued to present a problem, particularly in the case of large, heavy sheets of stock.

Accordingly, it is an object of the present invention to provide an improved takeoff assembly which provides consistent performance in removing sheets of stock which may have curled or bent edges from a printing bed, and which is effective in handling various weights and sizes of stock. Further objects and advantages will become apparent from the following description and the accompanying drawings in which.

Figure 3:
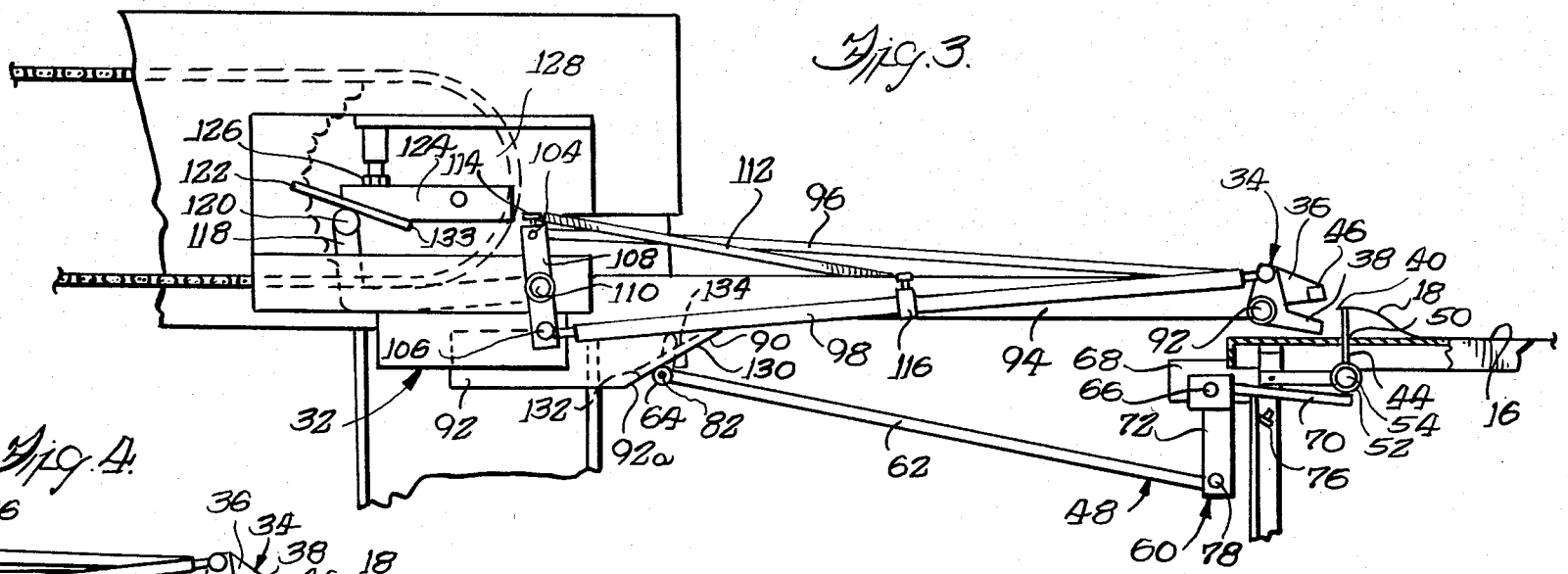
FIG. 3 is a front elevational view of the gripper assembly mechanism and the pin drive mechanism of the takeoff assembly of FIG. 1, shown on an enlarged scale and with portions broken away for clarity.

The present invention is generally embodied in a takeoff assembly 10 and a method of operation therefor. In the preferred embodiments, the method and apparatus of the present invention are used in conjunction with a screen printing press 12. The printing press 12 includes a press frame 14 which supports a planar support surface, or printing bed 16, upon which a sheet of stock 18 is positioned for printing, and a pivoting printing head 20 which descends to apply ink to the sheet. The takeoff assembly 10 is positioned adjacent the printing bed 16 and supported by the press frame 14 at one end and by two legs 22 and 24 at the other. The takeoff assembly is enclosed within a housing 26 having four generally rectangular sidewalls 28 and a top cover 30. As illustrated in FIG. 3, the takeoff assembly herein includes a traveling carriage 32 for transporting a plurality of grippers 34 having upper and lower jaws 36 and 38 respectively which are movable between open and closed positions. The grippers are carried toward a leading edge 40 of the sheet 18 with their jaws open until they reach a pick-up station adjacent the printing bed 16 with the sheet 18 located between the jaws. The jaws 36 and 38 are then closed to grip the leading edge 40 of the sheet 18 between them, and the grippers 34 are transported away from the printing bed 16 to remove the sheet 18.

Cutouts and drop edge mechanisms have been used in the past to expose portions of the sheet for gripper access, but have not proven satisfactory for consistently maintaining the leading edge of a sheet in a predetermined position. Because of this, mishandling of stock by grippers has heretofore been a problem in the operation of automatic takeoff apparatus.

In accordance with the present invention, a method and apparatus are provided for lifting an edge 40 of a sheet of stock 18 to a predetermined elevation above a support surface 16 so that it may be received between the jaws 36 and 38 of a set of grippers 34 and removed from the support surface by the grippers. The preferred method for lifting the edge 40 includes driving a plurality of pins 44 upward beneath the sheet 18 to push it away from the support surface 16, which in the illustrated embodiment is the printing bed. The pins 44 are offset with respect to the paths of the gripper jaws 36 and 38 so that the leading ends 46 of the gripper jaws may be advanced past the pins. The pins 44 are raised and lowered by a pin drive mechanism, indicated generally at 48, which operates in timed relation to the operation of the grippers 34. To ensure that the vertical position of the leading edge 40 of the sheet 18 does not vary substantially from that of the upper ends 49 of the pins 44, the pins are positioned to engage each sheet immediately adjacent its leading end. The pin drive mechanism 48 is configured to allow the printing bed 16 to be moved for micrometer registration without substantially altering the timing of the pin motion.

Figure 1:
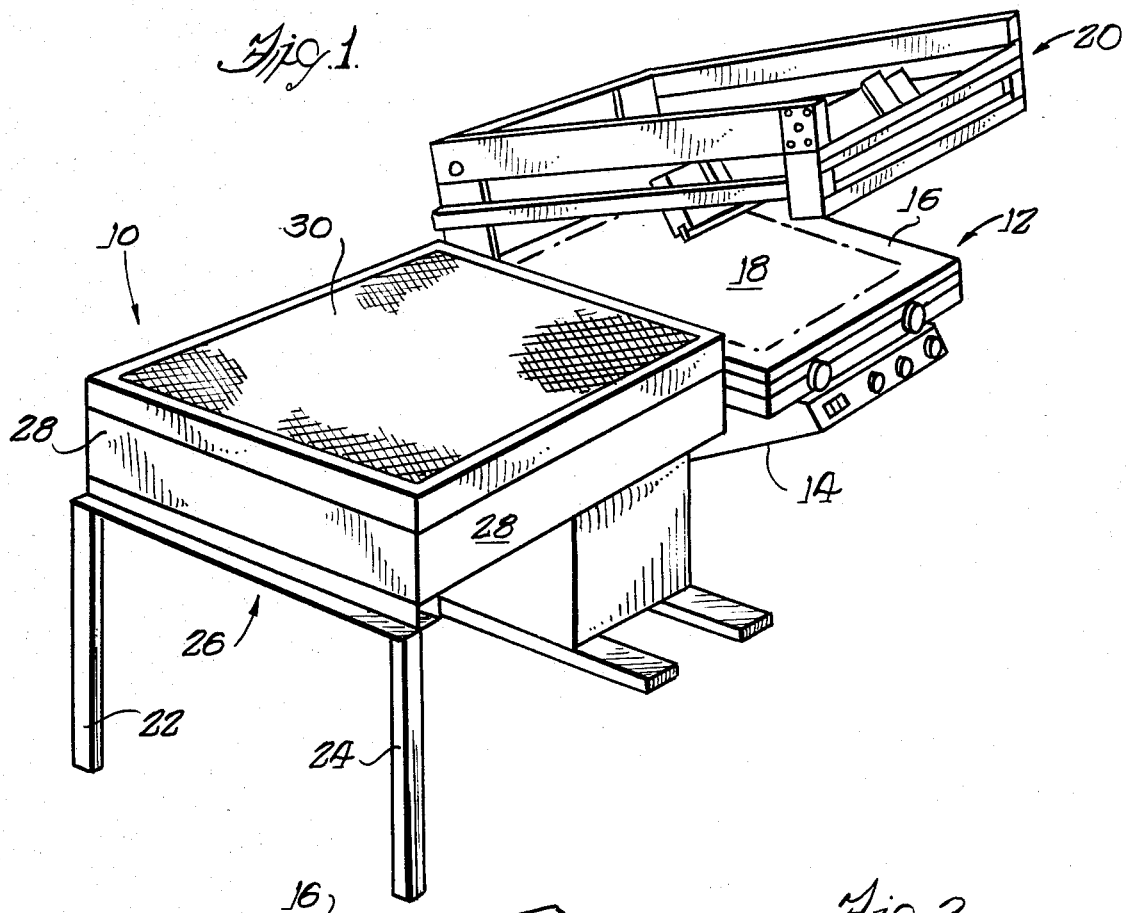
FIG. 1 is a perspective view of a takeoff assembly embodying the present invention, shown in assembled relation with a printing press.
Figure 2:
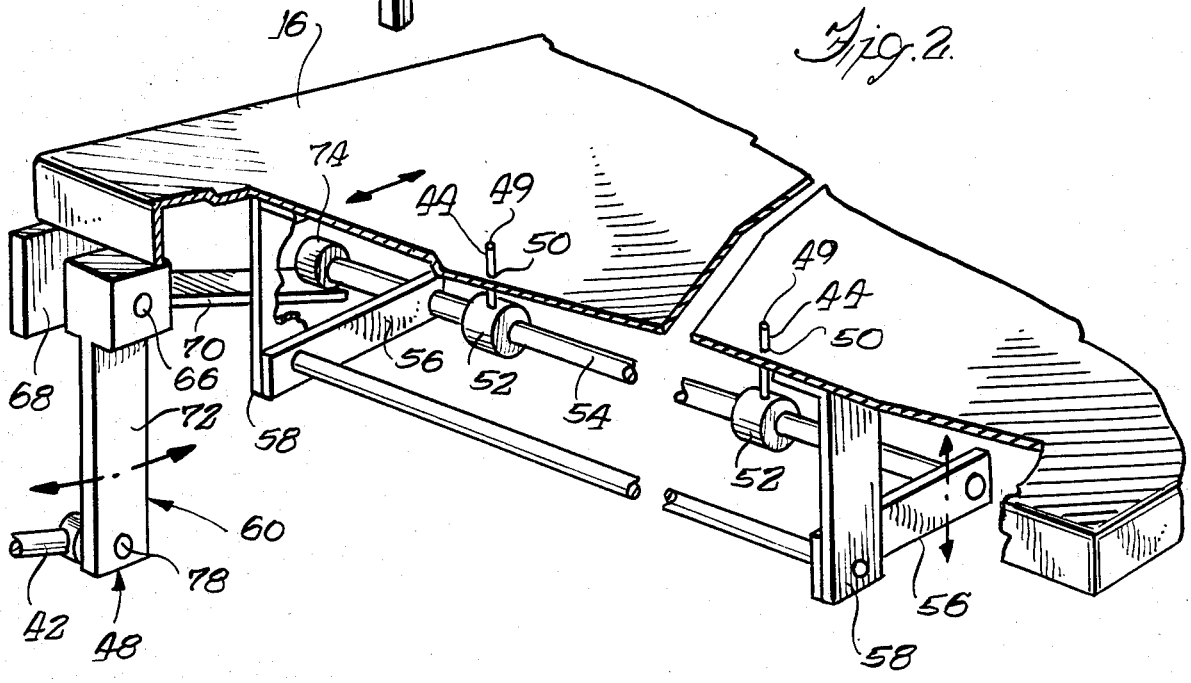
FIG. 2 is a perspective view of the pin drive mechanism of the takeoff assembly of FIG. 1, shown on an enlarged scale and with portions broken away for clarity.

Turning now to a more detailed description of the illustrated apparatus embodying the present invention and referring particularly to FIG. 2, the pins 44 are disposed in vertical bores 50 which extend through the printing bed 16. Each pin is fixed at its bottom end to the top of a ring 52 which is mounted upon a horizontal pin shaft 54. The horizontal shaft is fixed near its ends to a pair of pivot arms 56 which are pivotally mounted on brackets 58 depending from the printing bed 16.

Figure 5:
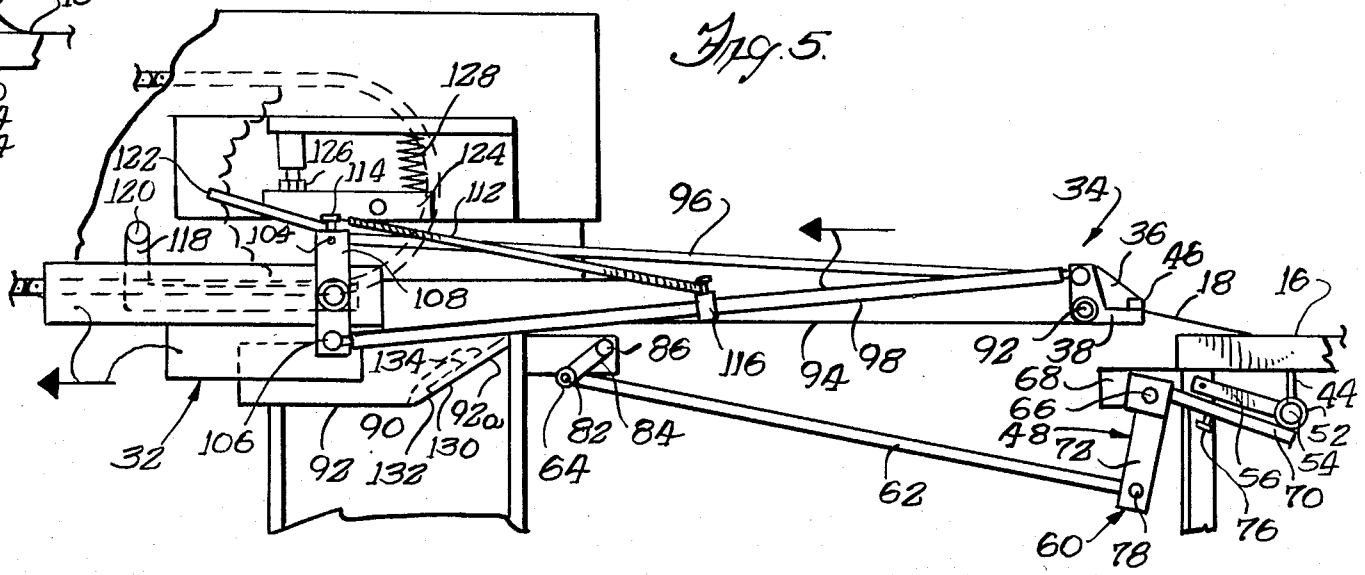
FIG. 5 is a front elevational view of the gripper assembly and the pin drive mechanism of FIG. 3, shown on an enlarged scale with the gripper assembly traveling away from the printing bed.

As best seen in FIGS. 3 and 5, the pin drive mechanism 48 which raises and lowers the pins 44 includes a bell crank 60 attached to an elongated connecting rod 62 to translate downward motion of a rolling cam follower 64 into upward motion of the horizontal pin shaft 54. The bell crank 60 pivots about a stud 66 fixed to a side member 68 of the press frame and has first and second arms 70 and 72 extending away from the pivot axis at approximately right angles to one another. The first arm 70 of the bell crank extends beneath the horizontal shaft 54 and contacts the bottom of a collar 74 (FIG. 2) coaxially disposed upon the shaft 54 so that the shaft 54 is raised when the bell crank 60 is pivoted counterclockwise. A stop 76 (FIGS. 3 and 5) fixed to the press frame 14 engages the bottom of the arm 70 to limit downward movement of the arm 70 and the shaft 54. The second arm 72 of the bell crank 60 extends downwardly away from the printing bed 16 and is pivotally attached by a pin 78 at its lower end to the forward end of the connecting rod 62. The opposite end of the connecting rod is attached to a pivot pin 82 (FIG. 3) which extends through a lower end of a cam follower arm 84 (FIG. 5). The cam follower arm 84 is pivotally attached at its upper end to a side member 86 of the takeoff housing. The rolling cam follower 64 is rotatably mounted upon the pivot pin 82 and positioned to engage a plate cam 90 which is fixed to a vertical support plate 92 which is pivotally attached to the carriage 32. The support plate 92 is generally trapezoidal in shape. The plate cam 90 is transversely fixed to an inclined front edge **92*a* of the support plate 92 so that as the carriage 32 travels forward, the cam follower 64 is forced downward and forward by the cam 90**.

Figure 4:
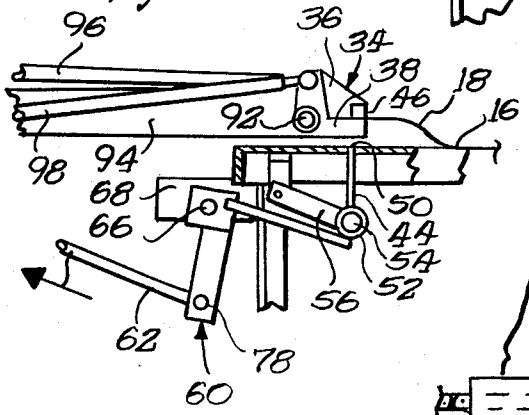
FIG. 4 is a fragmentary front elevational view of the gripper assembly and the pin drive mechanism of FIG. 3, shown on an enlarged scale with the gripper jaws in closed position, gripping a sheet of stock.

FIGS. 3, 4, and 5 illustrate an embodiment of the invention having a gripper assembly similar to that described in U.S. Pat. No. 3,792,857. Each gripper 34 includes upper and lower gripper jaws 36 and 38 which pivot about a transverse shaft 92 mounted at the end of a pair of horizontal support arms 94. Upper and lower connecting rods 96 and 98 are pivotally connected at their forward ends to the upper and lower jaws 36 and 38 respectively and are pivotally connected by pins 104 and 106 at their rearward ends to a link arm 108 which is fixed to a transverse cam follower shaft 110. Counterclockwise rotation of the cam follower shaft rotates the link arm 108 and thereby pulls the upper connecting rods 96 rearward and pushes the lower connecting rods 98 forward to open the jaws 36 and 38. A coil spring 112 extending from the upper end 114 of the link arm 108 to a collar 116 on each lower connecting rod 98 urges the jaws 36 and 38 toward a closed position.

An L-shaped lever arm 118 with a cam follower roller 120 rotatably mounted at its upper end extends rearwardly and upwardly from the cam follower shaft 110 and is fixed thereto. The cam follower roller 120 is positioned to engage an inclined ramp 122 which is mounted on a pivotal support arm 124. The pivotal support arm 124 is biased toward a stop 126 by a spring 128 to maintain it in a predetermined position.

The operational cycle of the takeoff assembly 10 begins with the carriage 32 and grippers 34 traveling toward the printing bed 16 with the jaws 36 and 38 in the closed position. When the plate cam 90 reaches the pin-actuating cam follower 64, its lower surface 130 engages the cam follower 64 and forces it downward and forward, pivoting the cam follower arm 84 in a counterclockwise direction to the position shown in FIG. 3. As the cam follower arm 84 pivots, it pushes the connecting rod 62 in the direction of the printing bed 16 to rotate the bell crank 60 in a counterclockwise direction. The rotation of the bell crank 60 displaces the pin shaft 54 upward and pushes the pins 44 above the surface of the printing bed 16. As the pin-actuating cam follower 64 is displaced downward and the pins 44 are pushed upward by the pin drive mechanism 48, the gripper cam follower 120 is also displaced downward by the ramp 122 to rotate the link arm 108, pulling the upper connecting rod 96 rearward and pushing the lower connecting rod 98 forward to force the gripper jaws 36 and 38 open.

The carriage continues to travel toward the printing bed 16 until the rearward end 132 of the pin-actuating plate cam 90 passes the pin-actuating cam follower 64. At this point, the downward force on the cam follower 64 is terminated, permitting the pin shaft 54 to drop to its initial position. At approximately the same point, the gripper cam follower 120 reaches the forward end 133 of the ramp 122, permitting the cam follower arm 118 to pivot upward, and allowing the gripper jaws 36 and 38 to close upon the sheet 18. As shown in FIG. 4, the front ends 46 of the jaws are beyond the pins 44 at this point.

Once the jaws 36 and 38 have closed, the gripper carriage 32 reverses direction and the sheet 18 is pulled from the printing bed 16. As the carriage 32 travels away from the printing bed 16, the upper surface 134 of the pin-acutating plate cam 90 meets the pin-actuating cam follower 64 and the support plate 92 is pivoted downward to enable the cam 90 to clear the cam follower 64. After the cam 90 has passed the cam follower 64, the support plate 92 pivots back to its initial position. Similarly, the gripper cam follower roller 120 engages the upper surface of the ramp 122, and the ramp support arm 124 pivots downward to permit the cam follower roller 120 to pass. The carriage 32 then continues to transport the grippers 34 away from the printing bed 16 until the sheet 18 reaches a delivery station where the gripper jaws 36 and 38 are opened and the sheet 18 is released.

The pin drive mechanism 48 herein permits horizontal adjustment of the position of the printing bed 16 to be made without substantial alteration of the timing between the pin drive mechanism 48 and the gripper operation. Such horizontal adjustments may be necessary to provide proper registration of sheets, and are generally on the order of a fraction of an inch in magnitude. To permit horizontal adjustments, the printing bed 16 is movably mounted upon the press frame 14 so that the printing bed may be moved by an adjustment mechanism (not shown) independently of the press frame. As best seen in FIG. 2, the collar 74 at the end of the pin shaft 54 rests on the first arm 70 of the bell crank 60 and may be moved relative to it while the bell crank remains in a stationary position. Thus, the bed 16 may be moved horizontally without displacing any of the components of the pin drive mechanism 48.

FIGS. 6 through 9 illustrate a gripper assembly 136 which may be used as an alternative to the gripper assembly described above. This gripper assembly 136 includes a traveling carriage 138 having a pair of elongated side frame members 140 joined by a transverse frame member 142, and a plurality of grippers 144 transported by the carriage 138. Each gripper has a fixed lower jaw 146 extending forward from the transverse member 142 and a pivoted upper jaw 148. To pivotally constrain the rear end of the upper jaw 148, a horizontal slot 150 in the transverse member 142 receives a bead 152 formed at the rear end of the upper jaw 148.

Each upper jaw 148 is urged downward by a pair of coil springs 154 which extend between each pair of jaws 148 and 146. To force the jaws open, a camshaft 156 coextensive with the transverse member 142 is rotated between the jaws so that a cam 158 engages a lower surface of each upper jaw 148 to pivot it upward. A cam follower arm 162 fixed to the camshaft 156 extends downwardly therefrom and has a cam follower roller 164 rotatably mounted at its lower end. As the carriage 138 travels forward toward the printing bed 165, the roller engages an inclined upper surface 166 of a ramp 168 (FIG. 7) and rotates the camshaft 156, forcing the jaws open.

Figure 6:
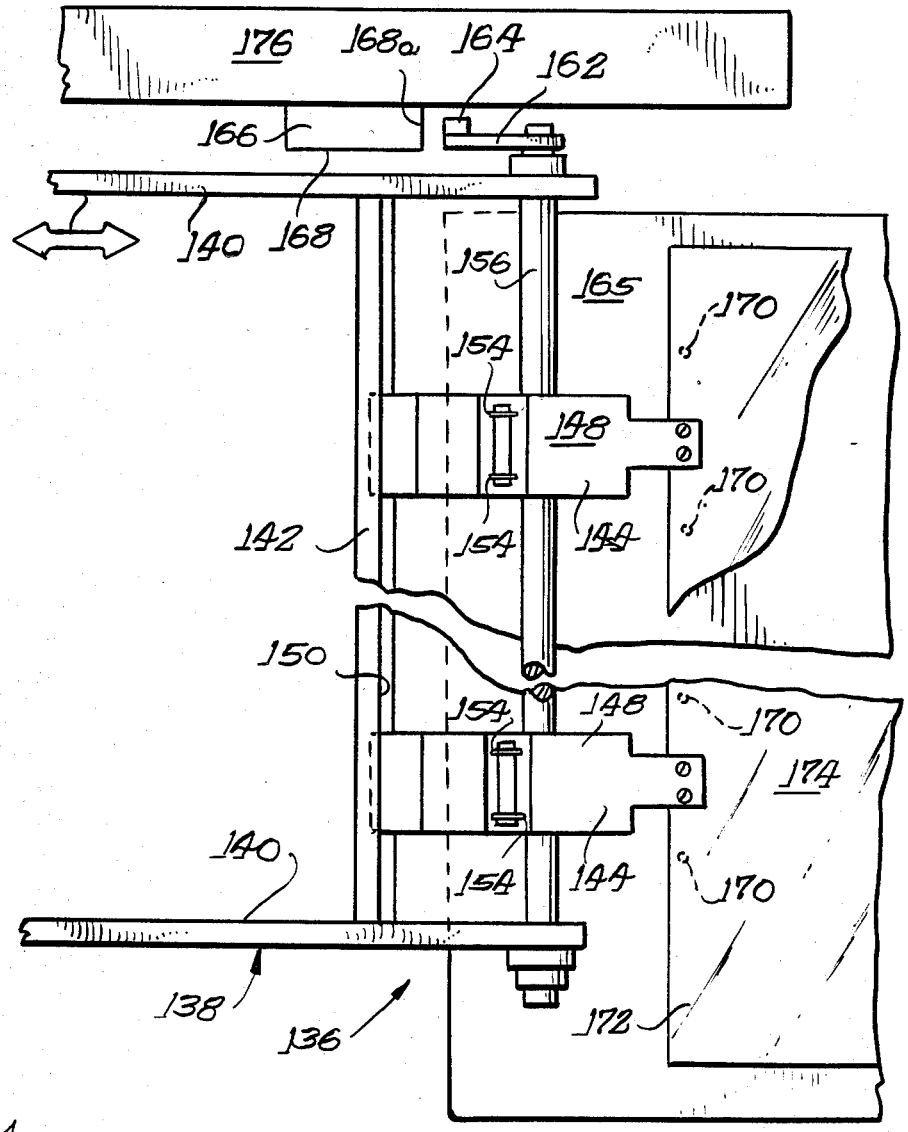
FIG. 6 is a plan view of takeoff apparatus in accordance with an alternate embodiment of the present invention.
Figure 7:
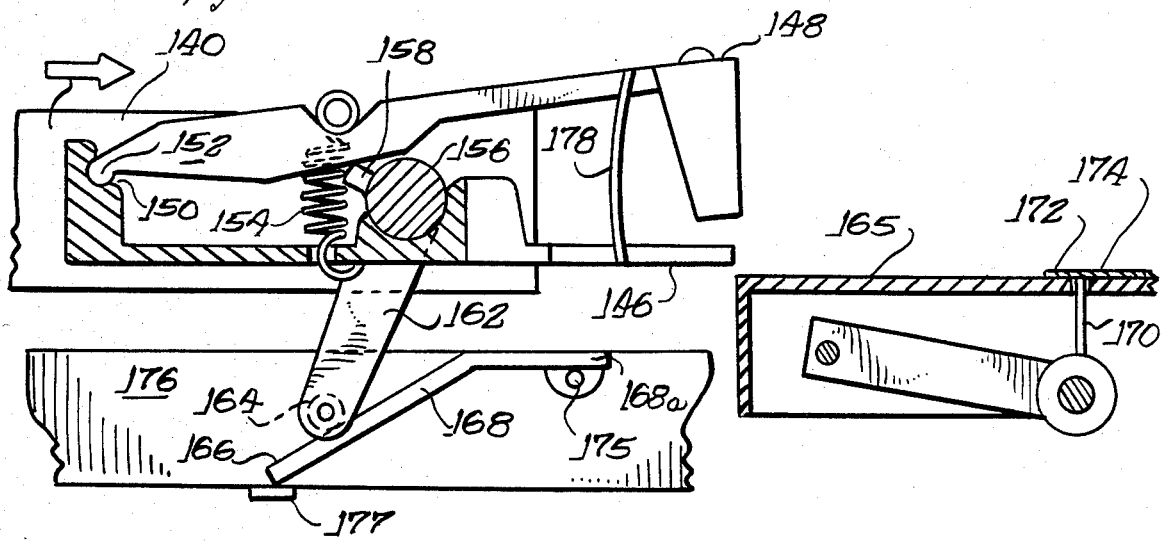
FIG. 7 is a fragmentary side elevational view of the gripper assembly of FIG. 6, shown on an enlarged scale and partially in section, with the gripper assembly moving toward a sheet of stock.
Figure 8:
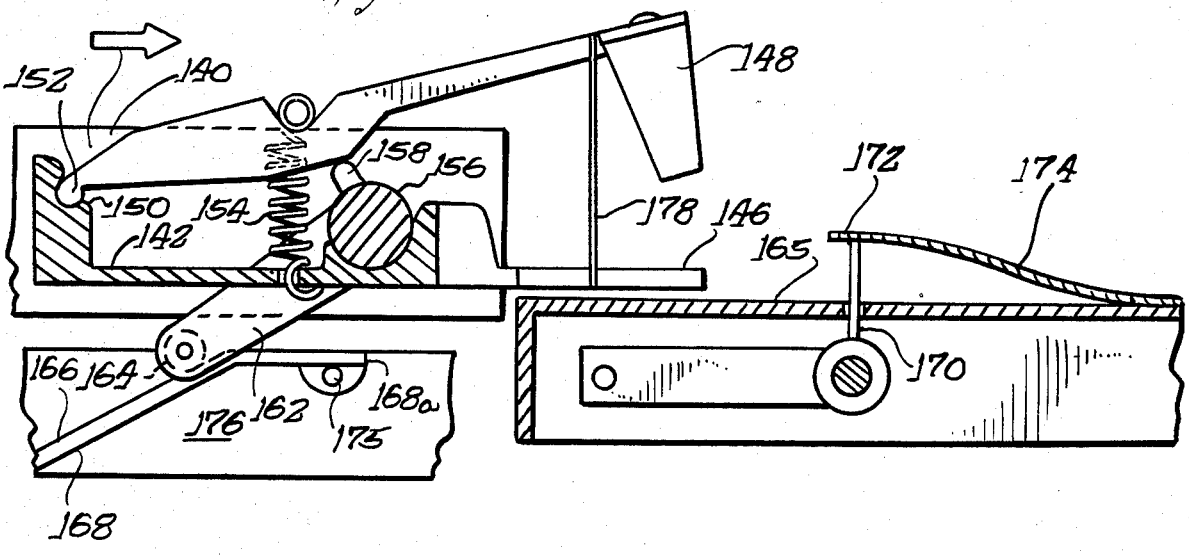
FIG. 8 is a framentary side elevational view of the gripper assembly of FIG. 6, shown on an enlarged scale and partially in section, with the gripper assembly moving toward a sheet of stock.
Figure 9:
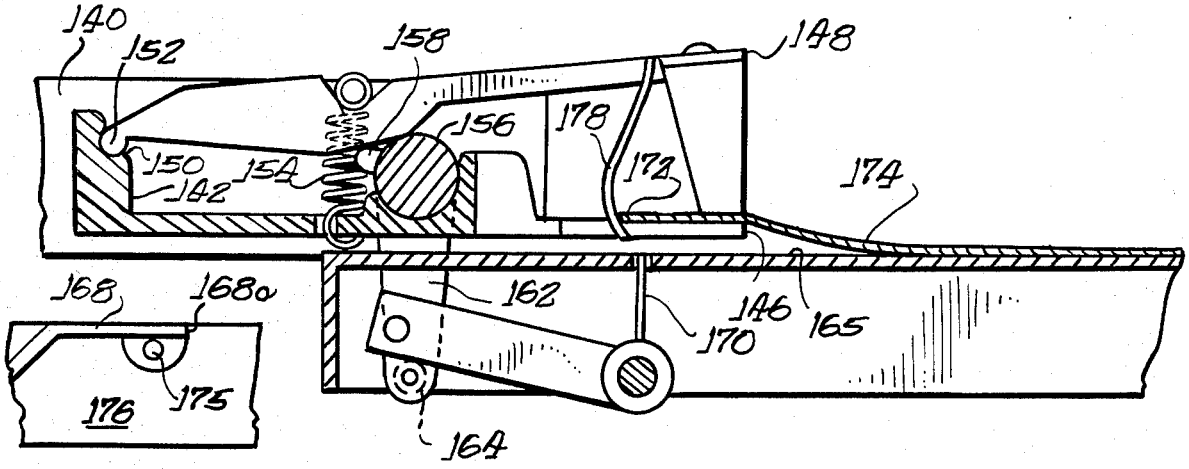
FIG. 9 is a framentary side elevational view of the gripper assembly of FIG. 6, shown on an enlarged scale and partially in section, with the gripper jaws in closed position, gripping a sheet of stock.

The pins 170 are simultaneously raised by a mechanism such as that described above and illustrated in FIGS. 2, 3, 4 and 5 which is timed to cooperate with the operation of the grippers 144 so that the leading edge 172 of the sheet 174 is positioned to be received between the upper and lower jaws 148 and 146 as the jaws approach (FIG. 8). As the lower jaws 146 arrive beneath the leading edge of the sheet, the pin mechanism lowers the leading edge 172 of the sheet onto the lower jaws 146 and the cam follower 164 subsequently rolls off the forward end **168*a* of the ramp 168 to permit the upper jaws 148 to pivot downward to grip the sheet. (FIGS. 6 and 9). The carriage 138 then reverses direction and transports the sheet 174** to the delivery station.

The ramp 168 is pivotably mounted upon a stud 175 extending inward from one of the side frame members 176 so that it may be displaced upward to permit the cam follower 164 to pass beneath it during the reverse travel of the carriage. A stop 177 (FIG. 7) fixed to the frame member 176 determines the undisplaced position of the ramp 168.

The large heavy sheets 174 are pulled by the grippers 144 and carriage 138 from the printing bed 165 to the left to a delivery station and the jaws 146 and 148 are opened to drop the sheets onto a receiving table (not shown). Since the sheets have considerable mass and are traveling at a relatively high rate of speed, their momentum carries them horizontally to the left as the grippers 144 are automatically opened when the sheet is positioned to be deposited onto the receiving table. The leading edges 172 of the sheets tend to stay within the opened jaws because of the sheet momentum after the jaws are opened. To positively eject each sheet 174 from between the gripper jaws 148 and 146 at the delivery station, a rubber diaphragm 178 extends from each upper jaw to its associated lower jaw so that opening the jaws at the delivery station stretches the diaphragm and pushes the sheet from between the jaws From the foregoing it may be seen that the present invention provides a consistent, reliable method and apparatus for removing sheets of stock from a printing bed. The method and apparatus of the present invention are particularly useful for handling large, heavy stock with curled edges, which has heretofore presented difficulties for automatic takeoff apparatus. The invention includes all modifications and alternate constructions of the method and apparatus described herein falling within the spirit and scope of the invention as defined in the appended claims.

What is claimed is:

1. Apparatus for transporting large sheets of stock which may have curled ends from a planar support surface to another location, comprising:

a stationary screen printing frame having a pivotally mounted printing head, a stationary, planar support surface for supporting a sheet of stock at a fixed planar location thereon beneath said printing head, gripper means for gripping a sheet of stock and transporting it, the gripper means comprising a plurality of grippers having upper and lower jaws movable between an open position for receiving a sheet of stock and a closed position for gripping a sheet, means for opening and closing the gripper jaws, carriage means mounted on the frame for transporting the grippers and a sheet gripped from the stationary planar support surface thereby to another location, and lifting means mounted on the stationary frame including pins for raising a leading end of the sheet of stock upwardly above the stationary, planar support surface and including a mechanical operated means actuated by said carriage means to lift said pins to ensure that the jaws of the grippers grip sheets of stock having curled ends.

2. Apparatus in accordance with claim 2 wherein the support surface is perforated to define a plurality of bores to guide the pins.

3. Apparatus in accordance with claim 2 wherein the support surface has an edge extending beyond the leading end of the sheet of stock so that the gripper jaws extend over the support surface when initially engaging the sheet of stock.

4. Apparatus for transporting large sheets of stock which may have curled ends from a first station to a delivery station, the apparatus comprising:

a stationary screen printing frame having a pivotally mounted printing head, a plurality of grippers, each having upper and lower gripping jaws movable between an open position for receiving a leading end of a sheet of stock between the jaws and a closed position for gripping the leading end of the sheet to pull the sheet from the support surface, carriage means for traveling relative to the stationary frame and for transporting the jaws in reciprocating motion toward and away from the support surface, a stationary planar support surface on said frame at the first station for supporting a sheet in a planar stationary position beneath said printing head, lifting means including pins for raising the leading end of the sheet of stock upwardly of the stationary planar support surface and subsequently lowering it onto the lower jaws, and a mechanically operated means actuated by said carriage means to lift said pins, and operating means for shifting the gripping jaws to the open position to receive the sheet in timed relation to the arrival of the carriage adjacent to the support surface and for shifting the gripping jaws to the closed position to grip the sheet after the lifting means has lifted the leading end of the sheet and lowered it onto the lower jaw.

5. A takeoff apparatus in accordance with claim 4 wherein the support surface defines a plurality of bores to guide the pins.

6. Apparatus in accordance with claim 4 wherein the operating means for opening and closing the grippers comprises a rotatable camshaft for opening the grippers and a spring means for closing the grippers.

7. Apparatus in accordance with claim 4 wherein each of the grippers has a lower jaw fixed to the gripper frame and an upper jaw pivotable mounted on the gripper frame.

8. Apparatus in accordance with claim 4 wherein each gripper has elastic diaphragm means extending between its upper and lower jaws to eject the sheet of stock from between the jaws when they are opened at the delivery station.

9. A takeoff method for transporting individual sheets of stock from a stationary planar support surface on a stationary screen printing frame having a pivotally mounted printing head by means of lifting pins to another location employing a gripper assembly having upper and lower jaws mounted on a reciprocating carriage and cooperating with a lifting means for lifting a leading end of a sheet to be transported, the method comprising the steps of:

supporting a sheet in a predetermined plane on the stationary planar support surface beneath the printing head, moving the gripper assembly and carriage toward the leading end of the sheet with the jaws in an open position, raising the leading end of the sheet upwardly from the planar stationary support surface by the lifting pins which are raised by a mechanically operated means actuated by the carriage, positioning the gripper assembly so that the leading end of the sheet stock is between the upper jaws and the lower jaws, closing the jaws to grip the sheet between them, and transporting the gripper assembly with the sheet held by the jaws to another location.

10. A takeoff method in accordance with claim 9 further comprising the additional step of lowering the leading end of the sheet onto the lower jaw prior to closing the jaws.

11. A takeoff method in accordance with claim 9 wherein closing the jaws comprises pivoting the upper jaws downward.

12. Apparatus for transporting large sheets of stock which may have curled ends from a planar support surface to another location, comprising:

a frame, a support surface for supporting a sheet of stock, gripper means for g ipping a sheet of stock and transporting it, the gripper means comprising a plurality of grippers having a movable upper and a fixed lower jaw between an open position for receiving a sheet of stock and a closed position for gripping a sheet, means for opening and closing the gripper jaws, carriage means mounted on the frame for transporting the grippers and a sheet gripped thereby to another location, said support surface having holes therein and being movable toward or from the carriage for registration of the sheet on the support surface, lifting pins movable through the holes in the support surface for lifting the leading end of the sheet from the support surface to allow the jaws to grip the leading end, and means to raise and lower the pins in timed relation to the gripper motion with substantially the same timing even though the support surface has been moved for registration of the sheet.

* * * * *

UNITED STATES PATENT AND TRADEMARK OFFICE

CERTIFICATE OF CORRECTION

PATENT NO. : 4,512,563

DATED : April 23, 1985

INVENTOR(S) : HENRY J. BUBLEY

It is certified that error appears in the above-identified patent and that said Letters Patent is hereby corrected as shown below:

Column 1, line 38 after "grippers" insert the words --to grip the--.

Column 7, line 1 change "2" to --1--.

Column 7, line 49 change "pivotable" to --pivotably--.

Signed and Sealed this

*Thirteenth* Day of *August 1985*

[SEAL]

*Attest:*

DONALD J. QUIGG

*Attesting Officer*

*Acting Commissioner of Patents and Trademarks*